US005829960A

United States Patent [19]

Dreiman

[11] Patent Number: 5,829,960

[45] Date of Patent: Nov. 3, 1998

[54] SUCTION INLET FOR ROTARY COMPRESSOR

[75] Inventor: Nelik I. Dreiman, Tipton, Mich.

[73] Assignee: Tecumseh Products Company, Tecumseh, Mich.

[21] Appl. No.: 641,171

[22] Filed: Apr. 30, 1996

[51] Int. Cl.[6] ..... F04C 18/356

[52] U.S. Cl. ..... 418/63

[58] Field of Search ..... 418/63–67

[56] References Cited

U.S. PATENT DOCUMENTS

| | | | |
|---|---|---|---|
| 993,530 | 5/1911 | Kinney | 418/66 |
| 2,612,311 | 1/1952 | Warrick et al. | 418/63 |
| 3,711,225 | 1/1973 | Kolbe et al. | 417/440 |
| 3,813,193 | 5/1974 | Rinehart | 418/63 |
| 3,891,358 | 6/1975 | Ladusaw | 418/63 |
| 4,240,774 | 12/1980 | Ladusaw | 418/248 |
| 4,560,329 | 12/1985 | Hirahara et al. | 418/63 |
| 4,608,002 | 8/1986 | Hayase et al. | 418/86 |
| 4,702,682 | 10/1987 | Takao et al. | 418/259 |
| 4,884,956 | 12/1989 | Fujitani et al. | 418/63 |
| 5,339,652 | 8/1994 | Dreiman | 62/296 |
| 5,348,455 | 9/1994 | Herrick et al. | 418/63 |
| 5,374,171 | 12/1994 | Cooksey | 418/63 |

FOREIGN PATENT DOCUMENTS

| | | | |
|---|---|---|---|
| 647172 | 6/1937 | Germany | 418/66 |
| 419198 | 3/1947 | Italy | 418/64 |
| 58-88487 | 5/1983 | Japan | 418/63 |
| 60-195397 | 10/1985 | Japan | 418/63 |
| 1-244191 | 9/1989 | Japan | 418/63 |
| 2-173383 | 7/1990 | Japan | 418/63 |
| 4-203387 | 7/1992 | Japan | 418/63 |
| 4219489 | 8/1992 | Japan | 418/63 |
| 5-202875 | 8/1993 | Japan | 418/63 |
| 1137246 | 1/1985 | U.S.S.R. | 418/63 |

*Primary Examiner*—John J. Vrablik
*Attorney, Agent, or Firm*—Baker & Daniels

[57] ABSTRACT

A suction inlet passage in a cylinder block of a rotary compressor includes a generally symmetrical diverging port which has generally conic cross-sections that divergingly open into a cylinder bore. The diverging port provides a buffer cavity which reduces pulsations and associated noise. The suction inlet passage is further provided with an entrance passage and a narrower passage, which is disposed between the entrance passage and the diverging port and which has a smaller cross-section than either the entrance passage or the diverging port. The suction inlet passage serves as a diffuser with the narrower passage functioning as the throat of the diffuser so as to increase volumetric efficiency with respect to the suction gas entering the cylinder bore. The diverging port extends the point of suction inlet close-off, and correspondingly enlarges the close-off angle, resulting in extending the period of unclosed compression and enhancing the supercharging effect. In this manner, the improved suction inlet passage increases volumetric efficiency, reduces pulsations and associated noise, and increases the pressure of the suction gas in the cylinder bore at the beginning of the compression cycle.

26 Claims, 5 Drawing Sheets

SUCTION INLET FOR ROTARY COMPRESSOR

BACKGROUND OF THE INVENTION

This invention pertains to hermetic rotary compressors for compressing refrigerant in refrigeration systems such as refrigerators, freezers, air conditioners and the like. In particular, this invention relates to modifying the suction gas intake passage to improve volumetric efficiency and reduce pressure pulsations and noise.

In general, prior art rotary hermetic compressors comprise a housing in which are disposed a motor and compressor cylinder block. The motor drives a crankshaft for revolving a rotor or roller (piston) inside the cylinder. One or more vanes are slidably received in slots located through the cylinder walls for separating areas at suction and discharge pressure within the cylinder bore. The vane(s), cooperating with the rotor and cylinder wall, provide the structure for compressing refrigerant within the cylinder bore.

During rotary compressor operation, the vane(s) and the roller divide the cylinder block cavity into a variable volume suction chamber and compression chamber. During each revolution or cycle, refrigerant gas is drawn from an accumulator, adjacent and external of the rotary compressor, into the suction chamber and the refrigerant gas already in the compression chamber is simultaneously compressed and discharged out of the cylinder.

The kinematic profile associated with rotary compressor operation is as follows. In general, the suction process in the formed suction chamber and the compression process in the formed compression chamber should start from the "top dead" center position at $\alpha$ (alpha) equals zero, where $\alpha$ equals the angle taken at the center of the cylinder bore between the sliding vane and the point of contact between the rolling piston or roller and the cylinder bore sidewall. At the top dead center position, the point of contact between the rolling piston and the sidewall is at the sliding vane, resulting in $\alpha$ being equal to zero. As the rolling piston is moved by the crankshaft and eccentric assembly, it closes off the suction port at point C (see FIG. 3) so as to prevent the introduction of any further suction gas into the now formed closed compression chamber formed in the cylinder bore.

As shown in FIG. 3, with the roller piston at position C, $\alpha$ equals $\alpha_C$, where $\alpha_C$, is the angle at which the suction port is closed by the roller. The period of compressor operation between $\alpha$ equals zero and $\alpha$ equals $\alpha_C$, is defined as "early unclosed compression" or simply "unclosed compression." During unclosed compression some initial compression of suction gas occurs prior to the beginning of the closed compression cycle. At $\alpha$ equals $\alpha_C$, the pressure of the suction gas in the suction chamber is at a peak, and it is at this point that the closed compression cycle begins. At the start of the closed compression cycle, at $\alpha$ equals $\alpha_C$, the pressure associated with the suction gas in the compression chamber is higher than the pressure associated with the suction gas in the originally formed suction plenum. By increasing the pressure of the suction gas in the compression chamber at the beginning of the closed compression cycle, a corresponding rise in the compressor volumetric efficiency is achieved. This is known as the supercharging phenomenon.

The fact that the pressure of the suction gas in the compression chamber is higher than the reference suction pressure at the start of the closed compression cycle can be attributed to two different effects. The first effect, early unclosed compression, is due to the deviation of the suction port from the top dead center position. This effect is referred to as passive supercharging.

The second effect is referred to as active supercharging and is due to wave dynamics associated with the suction inlet conduit. During the beginning of the suction process of each rotary cycle, the suction chamber volume increases until it reaches a maximum. Due to the inertia properties of gas, the suction gas entering the cylinder cannot fill the rapidly expanding suction chamber volume fast enough. This results in a pressure drop associated with the suction gas in the suction chamber. During the last part of the suction process, the rate at which the suction chamber volume changes decreases. However, because of the acceleration of the suction gas during the first stage of the suction cycle, the suction gas in the suction passage has attained a heightened level of speed and momentum. Again, because of the inertia properties of gas, the fast flowing suction gas continues to enter the cylinder at a high rate, resulting in a rising gas pressure in the cylinder bore.

U.S. Pat. No. 5,374,171 (Cooksey) is assigned to the assignee of the present invention and is incorporated herein. The '171 patent discloses a rotary compressor having a cylinder block with a cylinder bore formed therein for receiving a rolling piston which is drivingly connected to a shaft and eccentric assembly. A generally tubular suction inlet passage extends radially through the cylinder block and is disclosed as having a tubular suction port (52), which is in communication with cylinder bore (38).

U.S. Pat. No. 5,348,455 (Herrick, et al.) is assigned to the assignee of the present invention and is incorporated herein. The '455 patent discloses a rotary compressor having a cylinder block including a cylinder bore, which receives a rolling piston that is drivingly connected to a crankshaft and eccentric assembly. A generally tubular suction inlet passage (44) extends at first axially and then radially through the cylinder bore and is in communication with suction pressure area (45).

In the prior art, the suction gas is generally supplied through a cylindrical port formed in the wall of the cylinder block. This suction inlet port is in communication with the cylinder bore and is usually simply a hole having a straight tubular wall. One of the problems associated with prior art hermetic compressor arrangements is that the resistance to incoming suction gas from the suction gas accumulator is high, generally a resistance co-efficient of at least 0.5. The suction port acts as a throttle and the resistance to suction gas flow limits the efficiency of the compressor.

Another problem associated with rolling piston compressors of the prior art is the absence of a symmetrical suction cavity formed in the suction inlet passage. The absence of such a cavity results in suction pressure pulsations that are relatively high. The magnitude of the suction pressure fluctuation is a function of the motor speed, suction conduit length and diameter, etc.

A problem with known suction inlet volumes is that they are asymmetrical, such as disclosed in Japanese Document 58-88487 (Kawabe). The asymmetrical cavity provided at the suction inlet port results in gas flow separation, referred to as "stall," at the cavity boundaries due to irregular distribution of flow velocity along the cavity walls. Because the sliding vane provides a defining wall of the cavity, it is a variable volume cavity rather than a constant volume cavity. The asymmetrical cavity is characterized by the negative effects of flow reversal, or backflow, increased turbulence, and excess losses. The asymmetrical cavity of Kawabe may function as an accumulator to a limited degree, but it does not function as a diffuser.

SUMMARY OF THE INVENTION

The present invention overcomes the disadvantages of the above described prior art rotary compressors by providing a uniquely configured suction inlet passage which improves gas flow efficiency through enhanced pressure recovery and reduces noise and pressure pulsations by providing a pressure pulsation buffer means.

More specifically, the invention provides an improved suction system for use in rolling piston rotary type compressors, wherein the cylinder block is provided with an improved suction inlet passage. The improved suction inlet passage includes an entrance passage for receiving suction gas, a generally narrower passage for throttling the suction gas, and a generally diverging symmetrical suction gas inlet port formed in the cylinder sidewall and in communication with the cylinder bore. Further, the improved suction inlet passage provides enhanced passive supercharging by moving point C', see FIG. 4, relative to point C, see FIG. 3, farther from the top dead center position at $\alpha$ equals zero. By extending point C', the point at which the suction inlet passage is closed to the cylinder, away from the sliding vane, the present invention extends the period of unclosed compression and increases the suction gas pressure in the suction gas chamber at the start of the closed compression process. Closed compression begins $\alpha$ equals $\alpha C'$, the improved suction inlet passage effects an even greater pressure differential between the reference suction pressure at the suction gas entrance and the suction gas in the compression chamber.

Moreover, the suction inlet passage of the present invention is radially symmetrical and is characterized by an entrance passage having cylindrical cross-sections and a suction inlet port having conic cross-sections divergingly opening into the cylinder bore. The cylindrical shape of the entrance passage provides an increased volume at the entrance cavity and helps to accommodate the typical connecting tubing. The radially symmetrical port forms a cavity in the cylinder sidewall that serves as a buffer to provide superior wave dynamics. The suction inlet port buffer reduces pressure pulsations and noise associated therewith. In the alternative, the suction inlet port may also be axially symmetrical, thereby forming a paraboloidal cavity, or the like, that divergingly opens into the cylinder bore.

Yet another advantage associated with the present invention is that the entrance passage, the narrower passage, and the diverging port serve as a diffuser of suction gas. As a diffuser, the improved suction inlet passage restricts gas back flow due to the reduction in pressure in the reduced cross-section of the narrower passage, which functions as the throat of the diffuser. In addition, in the event of reverse refrigerant flow, the enlarged diverging port provides in a reduced pressure to restrict gas back flow. The rigid walls of the inlet port connected through the small diameter neck with the cylindrical entrance passage collectively form a vented Helmholtz resonator system. The formed system resonates as fluid oscillates in the neck in response to cyclic pressure fluctuations in the body of the suction inlet passage. The fluid in the neck forms the mass of the oscillator and fluid in the cavities can be considered the springs of the oscillator. The practically important property of the Helmholtz resonator is its ability to absorb acoustic energy at the natural frequency of the resonator and reduce overall sound radiated by the rotary compressor. Preferably, the entrance passage transitions into the converging passage in a stepped fashion so as to optimize the Helmholz effect. The following general characteristics are commonly associated with Helmholz resonators, rigid cavity walls, natural frequency of the resonator is much less than the time needed for fluid mass to transverse the resonator cavity, the cross-section of the resonator neck is much smaller than is the body of the cavity so the fluid velocity through the neck is greater than through the cavity.

Still another advantage of the present invention is the improvement in volumetric efficiency which is accomplished by prolonging the period of unclosed compression by moving the point of the beginning of the closed compression cycle from point C to point C'.

The invention, in one form thereof, provides a rotary compressor having a cylinder block disposed within a housing. The cylinder block includes a cylinder bore with a sidewall. A roller piston for compressing fluid is located within the bore and is rotatably driven by a drive mechanism which includes a crankshaft partially disposed within the bore. The drive mechanism further includes an eccentric portion about which the roller is disposed.

A vane is slidably disposed within the cylinder block and is in slidable contact with the roller so as to separate the suction pressure area from the discharge pressure area. A suction inlet passage is provided in said cylinder block and includes a diverging port. The diverging port is formed in the sidewall of the cylinder bore and is substantially radially symmetrical, with respect to a plane extending through the cylinder bore axis and the suction inlet passage axis, having conic cross-sections. The conic sections divergingly open into the cylinder bore. In this manner, the diverging port enhances the supercharging effect, extends the period of unclosed compression, and improves volumetric efficiency of the compressor.

In yet another embodiment, the invention provides a rotary compressor having a cylinder block disposed within a housing. The cylinder block includes a bore with a sidewall. A roller piston for compressing fluid is located within the bore and is rotatably driven by a drive mechanism, which includes a crankshaft partially disposed within the bore. The crankshaft further includes an eccentric portion about which the roller piston is disposed. A vane is slidably disposed within the cylinder block and is in slidable contact with the roller so as to separate the suction pressure area from the discharge pressure area.

A suction inlet passage is provided in the cylinder block and includes a substantially radially symmetrical suction inlet port which divergingly opens into the cylinder bore. The diverging port includes an inner portion providing a generally tubular suction gas flow path and being surrounded by a substantially radially symmetrical diverging supercharging outer portion. The supercharging outer portion diverges from the inner portion in a direction toward the cylinder bore. The supercharging outer portion extends the period of unclosed compression during compressor operation so as to enhance supercharging of the compression chamber.

In yet another embodiment, the present invention provides a method of increasing the supercharging effect associated with unclosed compression in a rotary refrigerant compressor. In general, the compressor includes a cylinder block which forms a suction inlet passage and a cylinder bore. The cylinder bore has a sidewall and receives a rotary piston. The period of unclosed compression is defined as the period in which the rotary piston moves from a first location on the sidewall, immediately following a compression cycle, to a second location on the sidewall. The second location is that point at which the suction inlet passage is completely closed off to a closed compression chamber formed in the cylinder bore and the period of closed compression begins.

The method includes the following steps. The suction inlet passage is provided with a substantially radially symmetrical suction inlet port in the sidewall which divergingly opens into the cylinder bore. The duration of a period of unclosed compression of a rotary compressor is prolonged by moving the second location farther away from the first location by means of the substantially diverging suction inlet port. A substantially radially symmetrical suction inlet cavity is formed at said suction inlet port which functions as an accumulator and as a pulsation attenuater.

BRIEF DESCRIPTION OF THE DRAWINGS

The above mentioned and other features and objects of this invention, and the manner of attaining them, will become more apparent and the invention itself will be better understood by reference to the following description of embodiments of the invention taken in conjunction with the accompanying drawings, wherein.

Figure 1A:
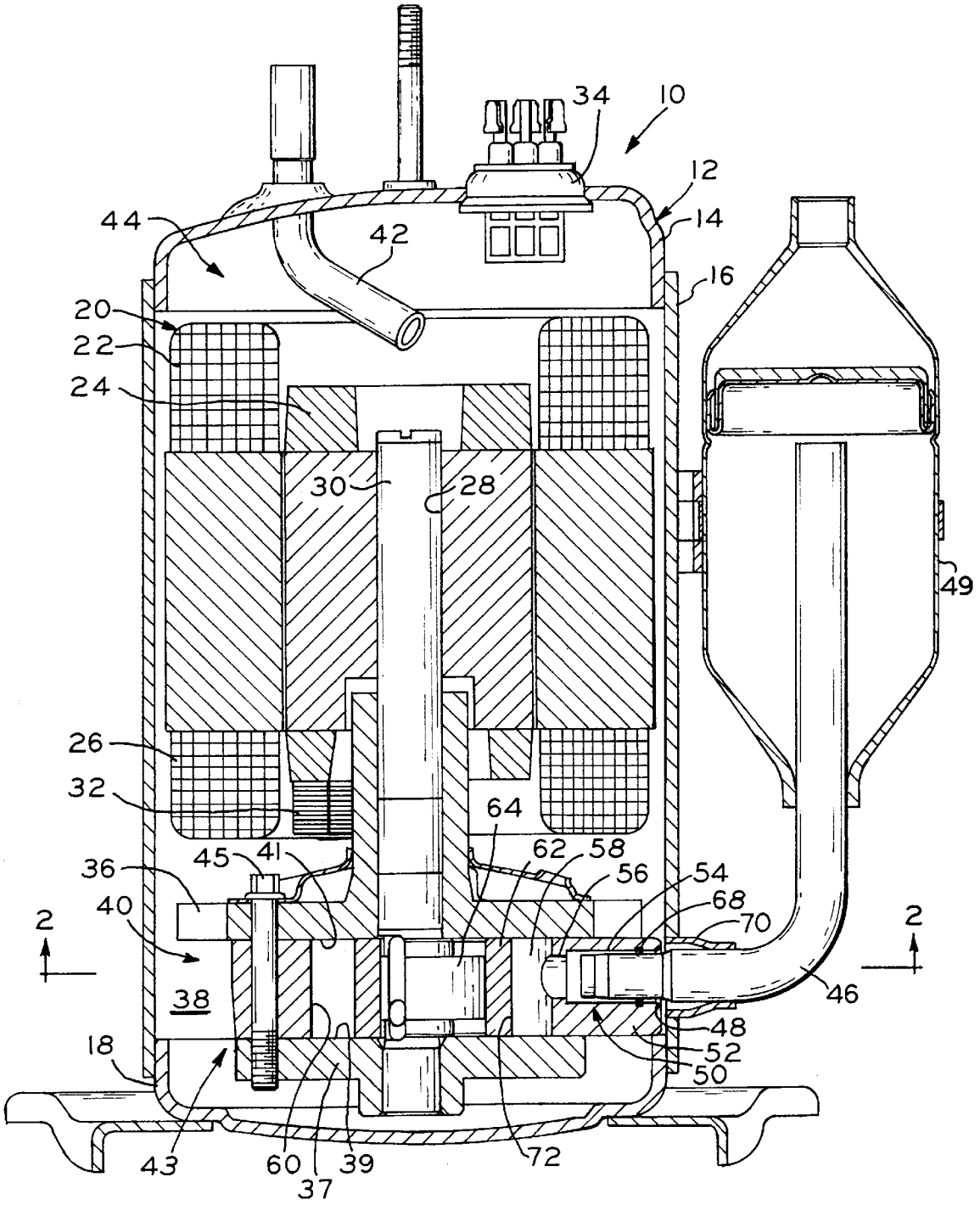
FIG. 1A is a side sectional view of a rotary compressor incorporating the present invention in one form thereof.

Corresponding reference characters indicate corresponding parts throughout the several views. The exemplifications set out herein illustrate a preferred embodiment of the invention, in one form thereof, and such exemplifications are not to be construed as limiting the scope of the invention in any manner.

DESCRIPTION OF THE PREFERRED EMBODIMENT

In an exemplary embodiment of the invention as shown in the drawings and in particular by referring to FIG. 1A, a compressor 10 is shown having a housing 12. Housing 12 has a top portion 14, a central portion 16, and a bottom portion 18. The three housing portions are hermetically secured together as by welding or brazing.

Located inside hermetically sealed housing 12 is a motor generally designated at 20 having a stator 22 and rotor 24. Stator 22 is provided with windings 26 and is secured to housing 12 by an interference fit such as by shrink fitting. Rotor 24 has a central aperture 28 provided therein into which is secured crankshaft 30, such as by an interference fit. Counterweight 32 is attached to the bottom of rotor 24. Terminal cluster 34 is provided on top portion 14 of compressor 10 for connecting motor 20 to a source of electric power. An inboard bearing or frame member 36 is attached to housing 12 below motor 20 by an interference fit and welding.

Figure 1B:
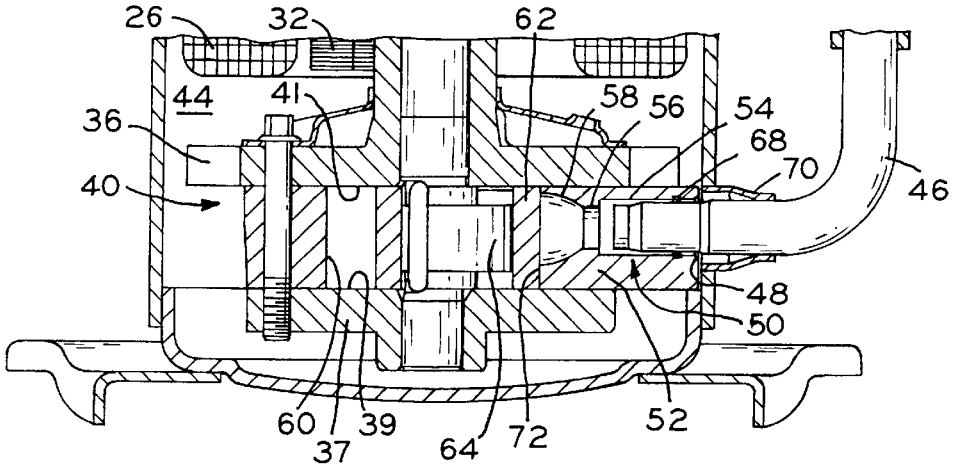
FIG. 1B is a partial sectional view of a rotary compressor showing the compressor mechanism of FIG. 1 incorporating an alternative diverging port configuration.
Figure 2:
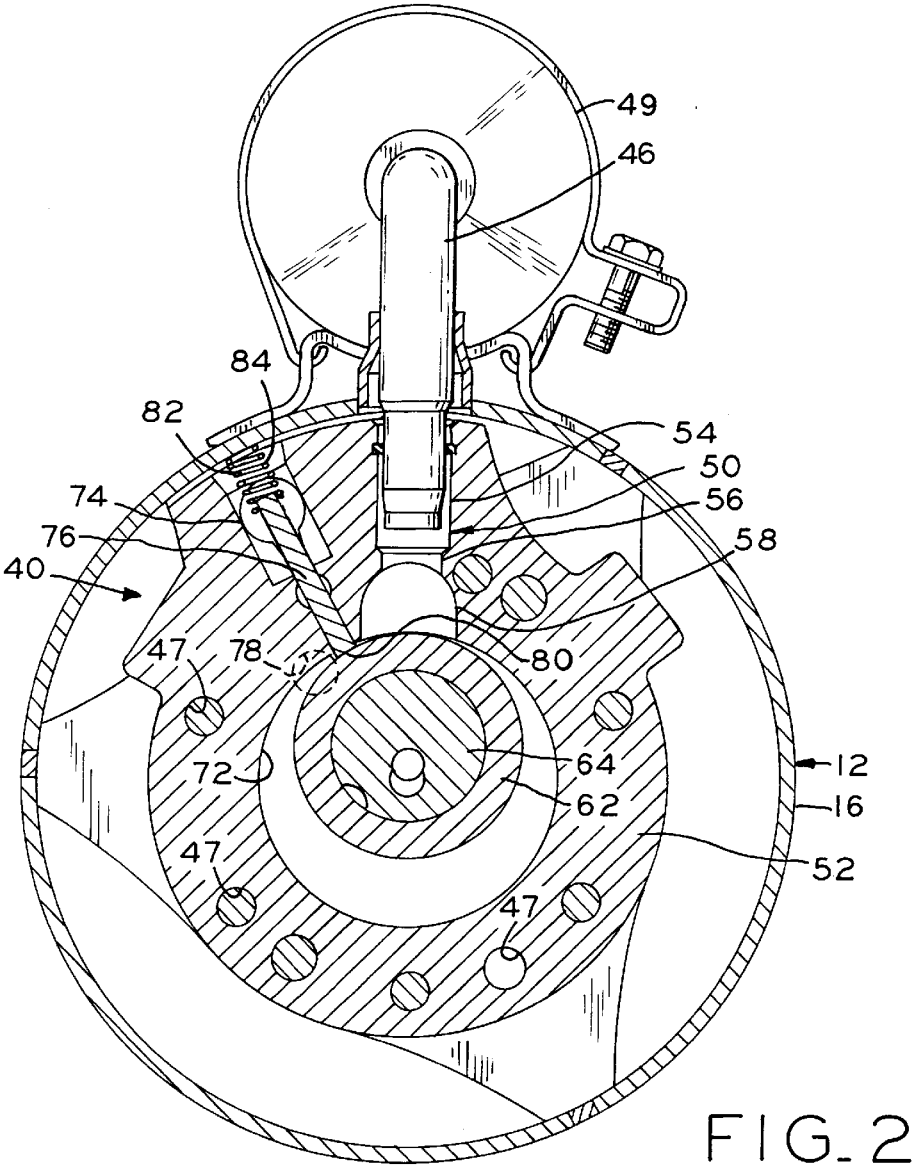
FIG. 2 is a sectional view of the compressor mechanism along line 2—2 of FIG. 1A and viewed in the direction of the arrows.

As shown in FIGS. 1A, 1B, and 2, compressor mechanism 40 is also contained in housing 12 and comprises a cylinder block 52 having a cylinder bore 60 in which a piston or roller 62 is disposed. Although shown below motor 20, compressor mechanism 40 may alternatively be located above motor 20. Outboard bearing 37, forming endwall 39, is attached, as by bolts 45, axially outward to one side of cylinder block 52. On its opposite side, cylinder block 52 is attached to inboard bearing 36 at endwall 41. Together, inboard bearing 36, cylinder block 52 and outboard bearing 37 form a cylinder block assembly 43. Bore 60 and endwalls 39 and 41 define the compression space for compressor mechanism 40. Endwall 39, on outboard bearing 37, rotatably supports crankshaft 30.

Crankshaft 30 is provided with eccentric 64, which revolves about the crankshaft axis as crankshaft 30 is rotatably driven by motor 20. Located within piston 62, eccentric 64 is formed as a portion of crankshaft 30. Alternatively, eccentric 64 may comprise a separate member that bolts on or attaches to crankshaft 30.

As shown in FIGS. 1A, 1B, and 2, suction inlet passage 50 and discharge port 78, communicate with cylinder bore 60. Suction inlet passage 50 is interfit with suction tube 46, which draws refrigerant from the evaporator of a refrigeration system (not shown). Discharge port 78 is in communication with the interior 44 of compressor 10 via a discharge valve (not shown). Compressor interior 44 is in communication with an associated refrigerant system (not shown) through discharge tube 42.

Refrigerant discharge tube 42 extends through the top portion 14 of housing 12 and has an end thereof extending into the interior 44 of compressor housing 12. Discharge tube 42 is sealingly connected to housing 12 as by soldering. Similarly, suction tube 46 extends into interior 44 of compressor housing 12 and into suction inlet passage 50 at suction entrance port 48.

Suction tube 46 is received by and transfers suction gas into suction inlet passage 50 at entrance passage 54. 0-ring or equivalent sealing means 68 seals suction tube 46 relative to cylinder block 52 so as to prevent discharge pressure gas contained in housing 12 from leaking into suction inlet passage 50. Suction inlet fitting 70 is sealingly mounted on housing 12 at central portion 16 and is sealed relative to suction tube 46 so as to prevent leakage of discharge pressure gas from within housing 12 to the environment surrounding compressor 10.

A conventional centrifugal oil pump (not shown) is operatively associated with the end of crankshaft 30, which is submerged in oil sump 38. During operation, the oil pump pumps lubricating oil upwardly through an oil passage (not shown) which extends longitudinally through crankshaft 30. The lubrication system is known from U.S. Pat. No. 5,022,146, assigned to the assignee of the present invention and expressly incorporated herein.

In accordance with the present invention, the improved suction inlet passage, denoted generally at 50, is provided in cylinder block 52 and includes entrance passage 54, narrower passage 56, and diverging port 58. During compressor operation, suction gas passes through entrance passage 54, narrower passage 56, and diverging port 58 and is introduced into suction chamber 66 of cylinder bore 60. The combination of these three parts in suction inlet passage 50 works as a diffuser to diffuse suction gas entering cylinder bore 60.

By providing narrower passage 56 with a reduced cross-section from that of entrance passage 54, it acts as the throat of the diffuser. Narrower passage 56 has the smallest cross-section and the lowest gas pressure of the three parts. According to the present invention, the pressure of the suction gas at the diffuser throat, narrower passage 56, can be represented by the relationship:

$$P_{th}=0.57(P_1)$$

where $P_1$ is the initial pressure of the incoming suction gas. Narrower passage 56 may be constructed as a simple chamfered inlet or as a stepped inlet. The quantity of suction gas delivered to compression chamber 86 is fixed by the area of the throat and the initial pressure of the suction fluid.

Diverging port 58, as shown throughout the several views, is substantially radially symmetrical in shape, with respect to plane 98 extending through cylinder bore axis 96 and suction inlet passage axis 100 and\or center point 102. Port 58 divergingly opens away from narrower passage 56 into cylinder bore 60. The generally conic cross-sections of diverging port 58 become increasingly larger as they open into cylinder bore 60 and form an enlarged cavity in cylinder bore sidewall 72. Diverging port 58 is a hollow cavity which divergingly extends inwardly, parallel to the axis of compressor 40. In one form, port 58 is limited by planer endwalls 39 and 41 of bearings 36 and 37, as shown in FIG. 1A. With suction fluid flowing therethrough, entrance passage 54, narrower passage 56, and diverging port 58 collectively provide a Helmholz resonator to absorb acoustic energy at the natural frequency of the resonator, as determined by the particular configuration of suction inlet passage 50, thereby acting as a pressure pulsation buffer means. The additional volume provided by the enlarged symmetrical cavity functions as a buffer so as to reduce suction pressure pulsations and improve volumetric efficiency and overall compressor performance.

Figure 7A:
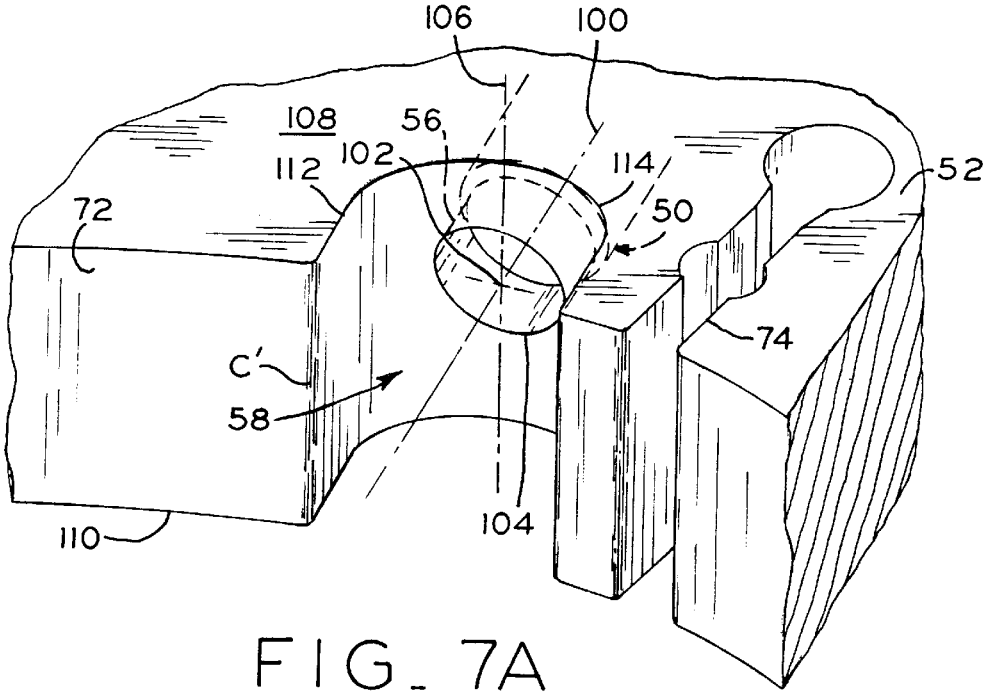
FIG. 7A is a cutaway perspective view of the cylinder block and particularly the diverging suction inlet port of FIG. 1A.
Figure 7B:
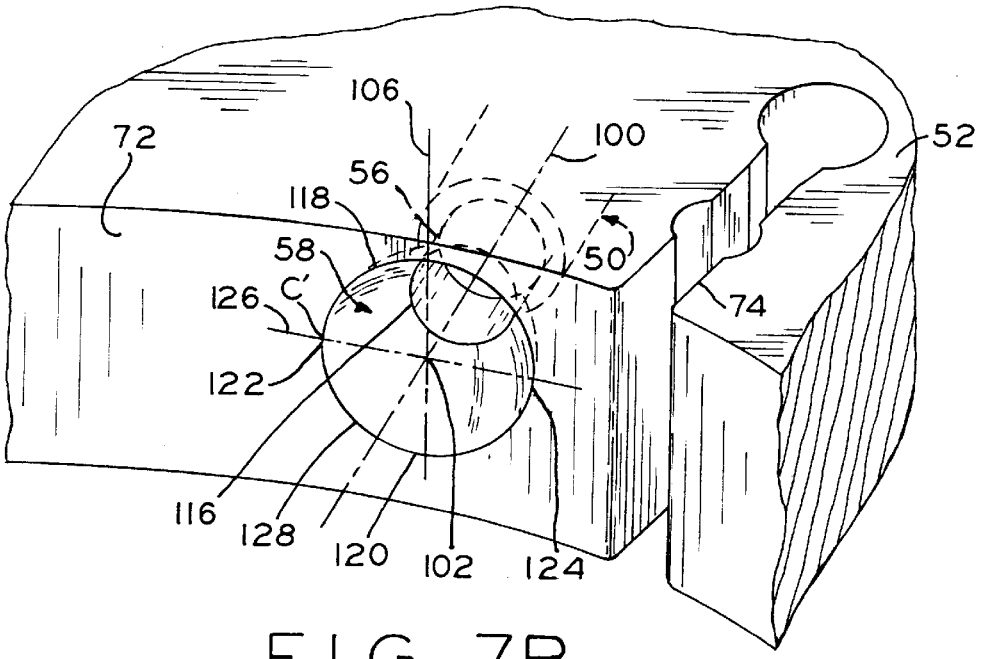
FIG. 7B is a cutaway perspective view of the cylinder block and particularly the diverging suction inlet port of FIG. 1B.

In the alternative suction inlet passage configuration of FIGS. 1B and 7B, diverging port 58 is also axially symmetrical so as to form a paraboloidal cavity, or the like. In this alternative configuration, both the axial and the radial cross-sections of diverging port 58 are essentially conic. The particular geometry of port 58 is discussed in more detail below.

Figure 3:
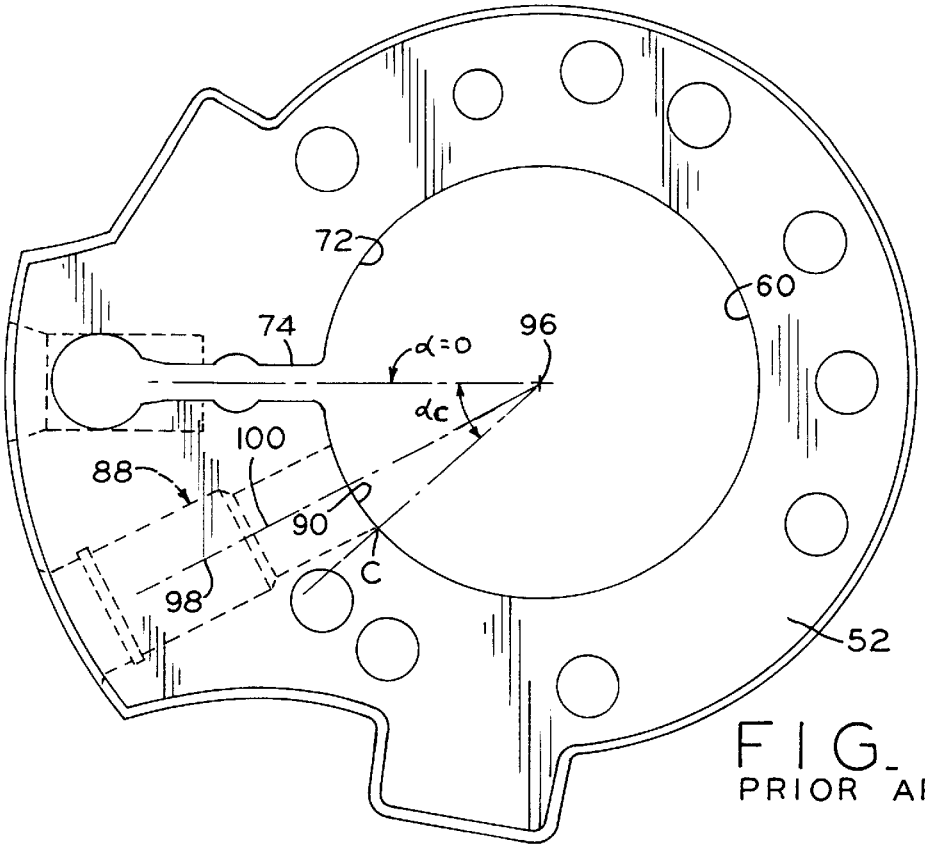
FIG. 3 PRIOR ART
FIG. 3 is a top view of a typical cylinder block of a prior art rotary compressor.
Figure 4:
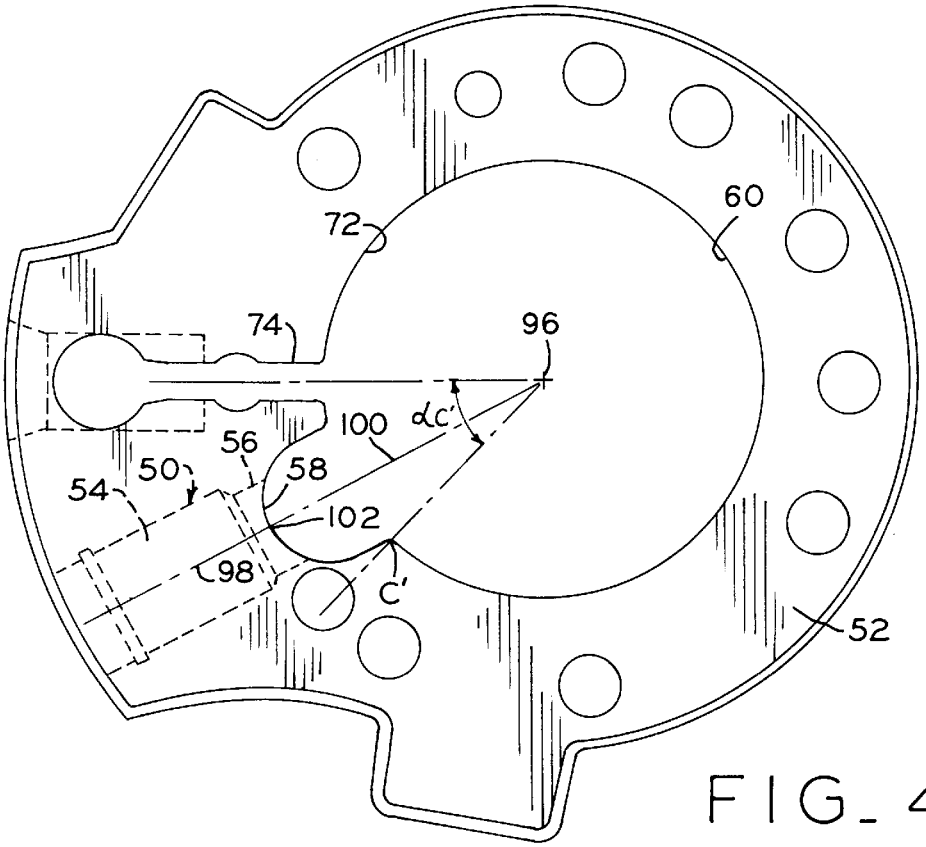
FIG. 4 is a top view of the cylinder block of FIG. 2.

In the prior art configuration of FIG. 3, suction gas is supplied through suction inlet passage 88 and is delivered into cylinder bore 60 at port 90 formed in sidewall 72 of cylinder bore 60. This prior art suction inlet port is simply a circular hole and the suction inlet passage is a generally straight tubular wall. A problem associated with this prior art arrangement is that the resistance to incoming suction gas from the suction gas accumulator is high, generally a resistance coefficient of at least 0.5.

Generally the value of resistance coefficient K associated with suction inlet passage 50 is represented as follows:

$$K=K'[1-(d/D)^2]^2;$$

where d is the diameter of the input aperture, D is the equivalent diameter of the diverging part of the port, and K' is a function of (D−d/2L), where L is the length of the transition. According to this formula, the resistance coefficient associated with suction inlet passage 50 of the present invention, as described above, is equal to 0.3. The resistance coefficient associated with prior art suction inlet passage 88 of FIG. 3 is 0.5. It is the diffuser operation associated with suction inlet passage 50, as described above, that achieves this improved resistance coefficient value.

The flow of suction gas through narrower passage 56 and diverging port 58 exhibits minimal forward pressure losses while increasing the efficiency and reliability of the compressor, especially at very high pressure ratios. By reducing the resistance coefficient, heat gain through suction inlet passage 50 is reduced, the general principles behind this operation are known as the Lavalle effect. Narrower passage 56 increases the velocity of suction fluid flowing from entrance passage 54 through to diverging port 58. The increase in velocity reduces the heat gain within inlet passage 50.

During operation of compressor mechanism 40, and with roller piston 62 at position $\alpha=\alpha_{C'}$, suction inlet 50 is essentially closed off with respect to cylinder bore 86. The inertia of inrushing suction fluid, now prevented from entering the cylinder bore, causes the fluid to engage the roller piston, which reverses the direction of the fluid back into diverging port 58 and into suction inlet 50 causing turbulence therein. The configuration of suction inlet passage 50, in particular diverging port 58 and narrower passage 56, lessens the negative effects of reverse refrigerant flow, the diffuser throat, narrower passage 56, reduces suction gas pressure so as to restrict suction gas backflow. Further, the enlarged buffer cavity, diverging port 58, provides a reduction in pressure so as to restrict suction gas backflow. The symmetrical shape of diverging port 58 provides an acoustic buffer means by which the frequency of the reverse flowing suction fluid is optimally 180° degrees out of phase with the inrushing suction fluid to reduce turbulence and its associated heat gain. The diffuser effect achieved by suction inlet passage 50 restricts reverse flow due to the reduction of pressure at diffuser throat 56 as well as at the cavity formed by enlarged diverging port 58.

Referring to FIG. 7A, diverging port 58 of FIG. 1A is shown as a symmetrical recess formed in cylinder block 52 having an opening 104 which is in communication with narrower passage 56. Axis 100 extends through suction inlet passage 50 and through opening 104 at center 102. The cavity formed by diverging port 58 opens outwardly into cylinder bore 60 and is radially symmetrical from top surface 108 to bottom surface 110 about the plane formed by axis 100 and axis 106. As illustrated in FIG. 1A, diverging port 58 is further defined by inboard bearing 36 and outboard bearing 37 in the completed assembly. Port side walls 112 and 114 are arcuate and essentially mirror one another such that cross-sections taken along axis 106 are conic in shape, i.e. may be elliptic, circular, parabolic, or hyperbolic. Side walls 112 and 114 may be chamfered at the interface with side wall 72, as shown in FIG. 7A, or may be stepped.

Referring to FIG. 7B, diverging port 58 is illustrated in the alternative arrangement of FIG. 1B as a radially and axially symmetrical recess formed in cylinder block 52 having an opening 116. Axis 100 extends through suction inlet passage 50 and through opening 116 at center 102. The cavity formed by diverging port 58 opens outwardly into cylinder bore 60 and is radially symmetrical from top point 118 to bottom point 120 about the plane formed by axis 100 and axis 106. The cavity formed by diverging port 58 is axially symmetrical from side point 122, at C', to opposite side point 124 about the plane formed by axis 100 and axis 126. Port side wall 128 is arcuate and cross-sections taken along axis 106 and axis 126 are conic in shape. Side wall 128 may be chamfered at the interface with side wall 72 or may be stepped.

Referring now to FIG. 2, a sectional view of compressor mechanism 40 along line 2—2 of FIG. 1A, it can be seen that cylinder block 52 includes a vane slot 74 provided in cylindrical sidewall 72 for receiving sliding vane 76. Spring 82 is received in spring pocket 84 and exerts a biasing force upon sliding vane 76 effecting continuous engagement between tip 80 and piston 62. During compressor operation, as illustrated in FIGS. 5 and 6, suction pressure chamber 66 and discharge compression chamber 86 are formed by cylinder bore 60, vane 76, roller 62, and planer endwalls 39 and 41 of bearings 36 and 37.

During compressor operation, as piston 62 rolls within cylinder bore 60, refrigerant enters bore 60 through diverging port 58. Next, compression volume 86 of FIG. 6 is enclosed by piston 62, cylinder bore 60, and sliding vane 76 and decreases in size as piston 62 moves clockwise, with respect to FIG. 2, within bore 60. Refrigerant contained in chamber 86 is compressed and exits through discharge port 78. The above described compressor mechanism is presented by way of example only, it being contemplated that other arrangements for compressing gas within bore 60 may be used without departing from the spirit and scope of the present invention.

Another aspect of the present invention is best illustrated in FIGS. 3 through 6, wherein the angle associated with unclosed compression, $\alpha$ (alpha), is illustrated according to the prior art and the present invention. FIG. 3 illustrates a typical prior art suction inlet passage 88 having a generally cylindrical discharge port 90. FIGS. 4–7B illustrate the improved diverging port of the suction inlet passage of the present invention as described above.

Figure 5:
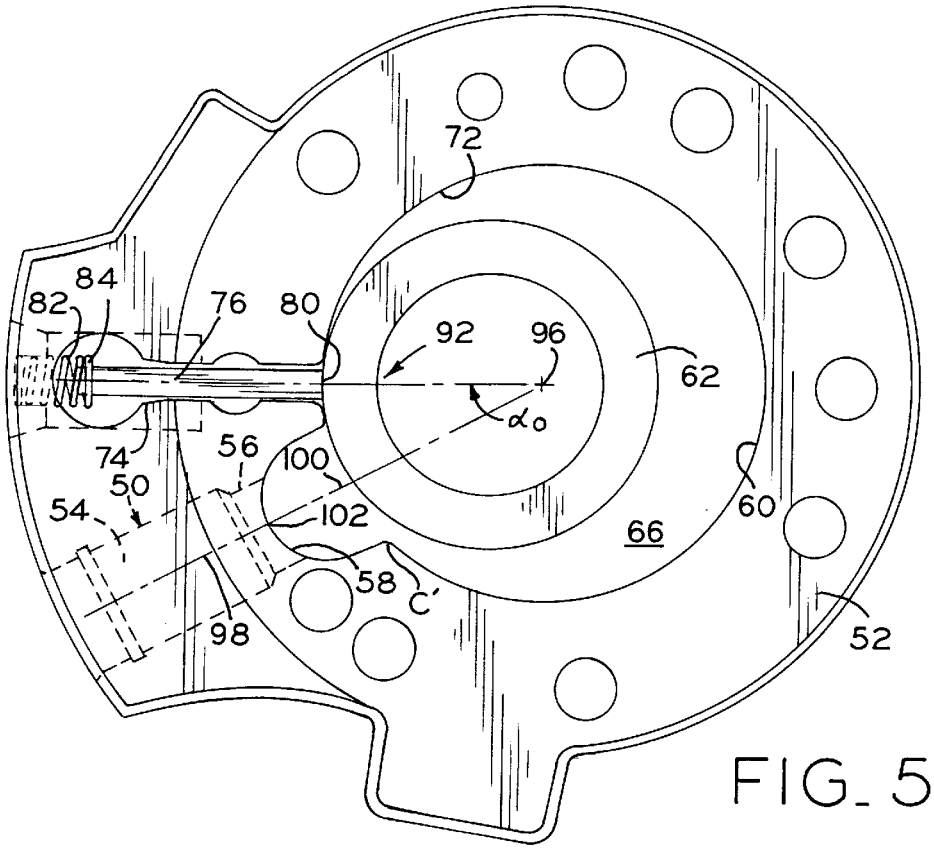
FIG. 5 is a top view of the compressor mechanism of FIG. 2 showing a rolling piston at a top dead center position.
Figure 6:
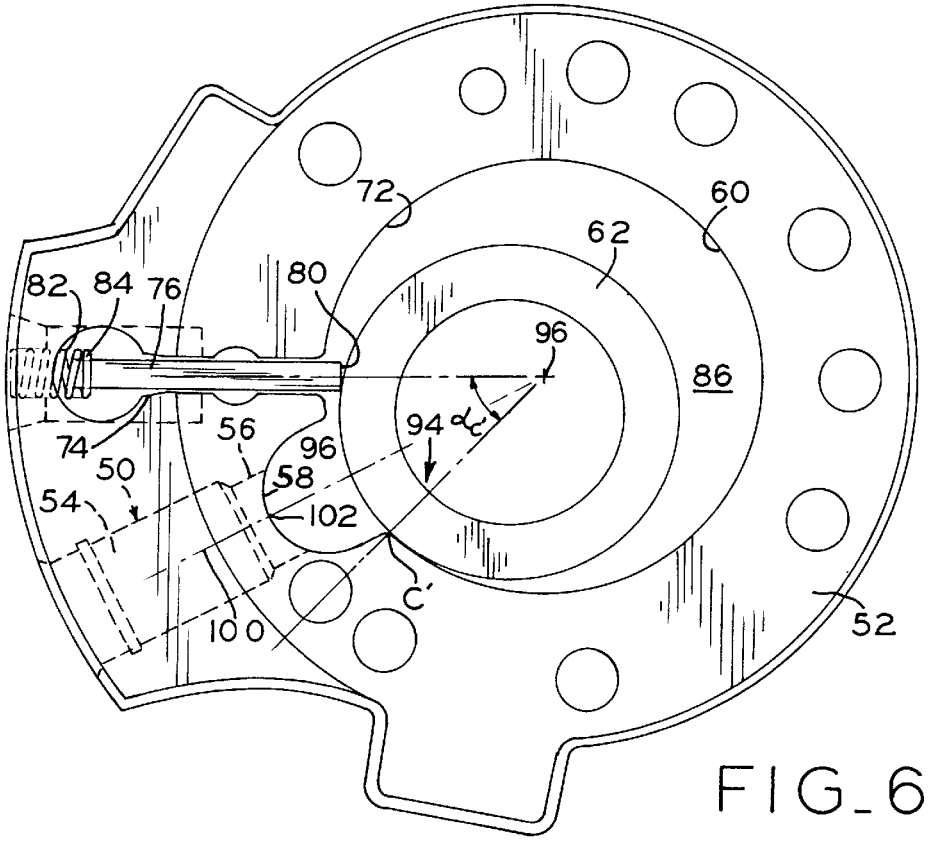
FIG. 6 is a top view of the compressor mechanism of FIG. 2 showing a rolling piston at a position C' at which early unclosed compression ends and closed compression begins.

Referring now to FIGS. 5 and 6, the period of unclosed compression is defined as the period in which the rotary piston moves from a first position 92 on sidewall 72, at $\alpha$ equals zero and immediately following a compression cycle, to a second position 94, at $\alpha$ equals $\alpha_{C'}$. Second position 94 is that point, C', at which suction inlet passage 50 is completely closed off to discharge compression chamber 86. The arrangement of the prior art of FIG. 3 discloses a second position, or point of close-off, at point C, whereat $\alpha$ equals $\alpha_C$. Enlarged suction inlet port 58 has the effect of extending the second position, and therefore extending the period of unclosed compression, from prior art position C to position C'. This correspondingly increases close-off angle a from $\alpha_C$, to $\alpha_{C'}$.

With roller 62 at first position 92, $\alpha$ equals zero and suction passage 50 is in communication with suction gas chamber 66, which receives suction gas from diverging port 58. At first position 92, discharge port 78 is closed off from cylinder bore 60 and there is essentially zero volume in discharge compression chamber 86. First position 92 is referred to as the top dead center position. During the suction process, as piston 62 moves from first position 92 to second position 94, designated at C', the suction gas entering suction chamber 66 is acted upon by an effect referred to as the supercharging phenomenon.

The supercharging phenomenon takes two forms, active and passive. The active supercharging phenomenon is due to wave dynamics associated with the shape of suction inlet passage 50 and the speed of the suction gas traveling therethrough. During the first part of the suction process of each rotary cycle, the rate of change associated with the volume of suction chamber 66 increases until reaching a maximum. Due to the inertia properties of gas, the entering suction gas cannot fill rapidly expanding suction chamber 66 fast enough, therefore, the suction gas pressure in suction gas chamber 66 experiences a pressure drop.

During the last part of the suction process, the rate of change in the volume of suction chamber 66 decreases. However, the entering suction gas has attained increasing speed and momentum during the first part of the suction process. Due to the inertia of the suction gas entering suction chamber 66, the fast flowing suction gas continues to enter suction chamber 66 at a high rate, even though the volume of chamber 66 is growing at a much reduced rate. The in-rush of suction gas into suction chamber 66 continues until roller 62 moves into second position 94, whereat suction inlet passage 50 is closed off with respect to cylinder bore 60. As described earlier, this occurs at point C in the prior art configuration of FIG. 3 and at point C' in the configuration of the present invention of FIGS. 4 through 6.

At $\alpha$ equals $\alpha_C$, in the prior art, or $\alpha_{C'}$, in the present invention, unclosed compression ends and closed compression begins. At points C and C', the suction pressure is at a respective peak. Accordingly, the closed compression process starts with a gas pressure in discharge compression chamber 86 that is higher than the reference suction gas pressure associated with suction inlet passage 50. This effects a rise in the compressor volumetric efficiency. Because second position C' of the present invention is farther removed from the top dead center position, first position 92, than second position C of the prior art, the suction inlet passage of the present invention extends the period of unclosed compression, raises the pressure of the refrigerant gas in compression chamber 86 at the beginning of the closed compression cycle, and provides enhanced supercharging over the prior art.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A rotary compressor comprising:

a housing;

a cylinder block disposed within said housing, said cylinder block having a cylinder bore forming a sidewall;

a roller piston disposed within said bore for compressing fluid;

a vane slidably disposed within said cylinder block, said vane in slidable contact with said roller piston, said cylinder bore, said roller piston, and said vane defining varying-volume suction and compression chambers;

a drive mechanism disposed within said housing for actuation of said roller piston; and a suction inlet passage provided in said cylinder block comprising:

a generally symmetrical entrance passage in communication with a refrigerant system suction line;

a generally symmetrical narrower passage; and a diverging port formed in said sidewall and being substantially radially symmetrical, said narrower passage interposed between said entrance passage and said diverging port and having a smaller cross-section than said entrance passage and said diverging port, said entrance passage sharply transitioning to said narrower passage in a substantially stepped fashion, said diverging port having substantially conic sections divergingly opening in a direction toward said cylinder bore, whereby said diverging port enhances supercharging effect, extends period of unclosed compression, and improves volumetric efficiency.

2. The compressor of claim 1 in which the length of said narrower passage is less than the length of said diverging port.

3. The compressor of claim 1 in which said suction inlet passage forms a suction gas diffuser and said narrower passage forms a throat of said suction gas diffuser.

4. The compressor of claim 3 in which the smallest cross-section associated with said diffuser occurs at said throat.

5. The compressor of claim 4 in which the cross-section of said throat is significantly smaller than the cross-section of said entrance passage and is adapted to provide a pressure that is approximately 0.57 of the incoming suction gas pressure at said entrance passage.

6. The compressor of claim 1 in which said diverging port forms a constant volume cavity, whereby said cavity provides a buffer to reduce pressure pulsations and associated noise.

7. The compressor of claim 1 in which said suction inlet passage is substantially symmetrical.

8. The compressor of claim 1 in which said diverging port forms a generally symmetrical cavity which functions as an accumulator, whereby separation of flow, back flow, turbulence, and associated pulsations are minimized.

9. The compressor of claim 1 in which said diverging port includes an input aperture having a first diameter and an output aperture having a second diameter, said diverging port gradually increasing in diameter from said input aperture to said output aperture over a given length, said input aperture, said output aperture, and said length adapted to provide a coefficient of resistance of approximately 0.3 or less.

10. The compressor of claim 1 in which said sidewall includes an opening that slidably receives said vane, said diverging port is located adjacent said opening with said vane being disposed intermediate said diverging port and a discharge port, during compressor operation and immediately following a compression cycle said roller piston moves to a first position on said sidewall so as to cover said discharge port, during further compressor operation said roller piston moves to a second position on said sidewall whereat said roller piston closes said diverging port with respect to said cylinder bore, said movement from said first position to said second position defines a period of unclosed compression, a compression chamber is formed in said cylinder bore and a period of closed compression begins with said roller piston at said second position, whereby supercharging causes suction gas in said cylinder bore to be at a higher pressure than suction gas at an entrance to said suction inlet passage at the beginning of closed compression.

11. The compressor of claim 10 in which a closeoff angle associated with said period of unclosed compression determines the amount of supercharing, whereby supercharging may be enhanced by enlarging said closeoff angle.

12. The compressor of claim 1 in which said diverging port is one of a group comprising; substantially parabolic, substantially hyperbolic, and substantially elliptic.

13. The compressor of claim 1 in which said diverging port is substantially axially symmetrical.

14. The compressor of claim 13 in which said diverging port forms one of a group consisting of a substantially paraboloidal cavity, a hyperboloidal cavity, and an ellipsoidal cavity.

15. The compressor of claim 1 in which said entrance passage is substantially symmetrical.

16. A rotary compressor comprising:

a housing;

a cylinder block disposed within said housing, said cylinder block having a cylinder bore forming a sidewall;

a roller piston disposed within said bore for compressing fluid;

a vane slidably disposed within said cylinder block, said vane in slidable contact with said roller piston, said cylinder bore, said roller piston, and said vane defining varying-volume suction and compression chambers;

a drive mechanism disposed within said housing for actuation of said roller piston; and a suction inlet passage provided in said cylinder block comprising:

a first inlet passage portion having an inlet end in communication with a refrigerant system suction line, and an outlet end;

a substantially diverging port formed in said sidewall and opening into said cylinder bore, said first inlet passage portion outlet being adjacent said diverging port, said first inlet passage portion having a smaller cross-section along a majority of its length than said diverging port, said diverging port being substantially radially symmetrical and comprising; an inner radially projecting volume providing a generally tubular suction gas flow path from said outlet end of said first inlet passage portion and being surrounded by a concentric symmetrical supercharging outer volume, said supercharging outer volume diverging from said inner volume in a direction toward said cylinder bore, thereby enlarging a suction inlet path associated with said diverging port and enhancing the volumetric efficiency of suction gas entering said cylinder bore.

17. The compressor of claim 16 wherein said supercharging outer volume extends from a first location on said sidewall to a second location on said sidewall, during compressor operation said roller piston engages said sidewall at said second location thereby closing said suction inlet passage with respect to said cylinder bore and ending a period of unclosed compression, whereby said supercharging outer volume extends said period of unclosed compression to enhance supercharging and effectively raise the pressure of the suction gas in said cylinder bore at the beginning of a closed compression cycle.

18. The compressor of claim 16 further wherein said suction inlet passage further comprises:

a generally symmetrical entrance passage in communication with a refrigerant suction line;

a generally symmetrical narrower passage interposed between said entrance passage and said diverging port and having a smaller cross-section than said entrance passage and said diverging port.

19. A rotary compressor comprising:

a housing;

a cylinder block disposed within said housing, said cylinder block having a cylinder bore with a sidewall, said cylinder bore having an area at suction pressure and an area at discharge pressure, said sidewall having an aperture therethrough;

a roller piston disposed within said bore for compressing fluid;

a vane slidably disposed within said cylinder block, said vane in slidable contact with said roller piston to separate said suction pressure area from said discharge pressure area;

a drive mechanism disposed within said housing for actuation of said roller piston; and a suction inlet passage provided in said sidewall aperture and comprising:

a generally symmetrical entrance passage in communication with a refrigerant system suction line;

a diverging port formed in said sidewall and in direct communication with said cylinder bore, said diverging port being substantially radially symmetrical and having generally conic sections divergingly opening into said cylinder bore;

a generally symmetrical narrower passage interposed between said entrance passage and said diverging port and having a smaller cross-sectional areas taken along its length than said entrance passage and said diverging port, said entrance passage sharply transitioning to said narrower passage in a substantially stepped fashion.

20. The compressor of claim 19, wherein said suction inlet passage functions as a Helmholz resonator to absorb acoustic energy.

21. The compressor of claim 19, wherein said diverging port is characterized by a coefficient of resistance of approximately 0.3 or less.

22. The compressor of claim 28, wherein said suction inlet passage forms a suction gas diffuser in which said narrower passage acts as a throat of said diffuser, said narrower passage causing an increase in the velocity of suction gas passing through said narrower passage from said entrance passage, thereby reducing the heat gain in said diverging port and increasing volumetric efficiency associated with suction gas entering said cylinder bore.

23. The compressor of claim 19, wherein said diverging port is substantially axially symmetrical.

24. The compressor of claim 23, wherein said diverging port forms one of a group consisting of a substantially paraboloidal cavity, a hyperboloidal cavity, and an ellipsoidal cavity.

25. The compressor of claim 19, wherein said cylinder block is an assembly comprising an upper plate, a lower plate, and a generally tubular sidewall.

26. A rotary compressor comprising:

a housing;

a cylinder block disposed within said housing, said cylinder block having a cylinder bore with a sidewall, said cylinder bore having an area at suction pressure and an area at discharge pressure, said sidewall having an aperture therethrough;

a roller piston disposed within said bore for compressing fluid a vane slidably disposed within said cylinder block, said vane in slidable contact with said roller piston to separate said suction pressure area from said discharge pressure area;

a drive mechanism disposed within said housing for actuation of said roller piston; and a suction inlet passage provided in said sidewall aperture and comprising:

a first passage portion in communication with a refrigerant system suction line;

a second passage portion terminating into a port formed in said sidewall and in direct communication with said cylinder bore, said diverging port being substantially radially symmetrical and having generally conic sections divergingly opening into said cylinder bore;

a third passage portion interposed between said first and second passage portions and having a smaller cross-section taken along its length than said first and second passage portions, said first portion sharply transitioning to said third portion in a substantially stepped fashion, said third passage portion causing an increase in the velocity of suction gas passing through said second passage portion, said suction inlet passage absorbing acoustic energy, reducing heat gain, and increasing volumetric efficiency associated with suction gas entering said cylinder bore.

* * * * *